US012751593B1

(12) United States Patent
Mihalescu

(10) Patent No.: US 12,751,593 B1
(45) Date of Patent: Oct. 6, 2026

(54) BUFFER STAIN APPLICATOR APPARATUS

(71) Applicant: Ghita Mihalescu, Lawrenceville, GA (US)

(72) Inventor: Ghita Mihalescu, Lawrenceville, GA (US)

( * ) Notice: Subject to any disclaimer, the term of this patent is extended or adjusted under 35 U.S.C. 154(b) by 2641 days.

(21) Appl. No.: 15/871,442

(22) Filed: Jan. 15, 2018

(51) Int. Cl.

| | |
|---|---|
| ***A47L 11/03*** | (2006.01) |
| ***A47L 11/16*** | (2006.01) |
| ***A47L 11/162*** | (2006.01) |
| ***A47L 11/40*** | (2006.01) |
| *A47L 11/14* | (2006.01) |

(52) U.S. Cl.
CPC ..... *A47L 11/1625* (2013.01); *A47L 11/4038* (2013.01); *A47L 11/03* (2013.01); *A47L 11/145* (2013.01); *A47L 11/4083* (2013.01)

(58) Field of Classification Search
CPC .... A47L 11/03; A47L 11/145; A47L 11/1625; A47L 11/4038; A47L 11/4083
See application file for complete search history.

(56) References Cited

U.S. PATENT DOCUMENTS

| | | | | |
|---|---|---|---|---|
| 3,366,288 | A * | 1/1968 | Goldschein | A47L 11/1625 15/50.1 |
| 4,339,840 | A * | 7/1982 | Monson | A47L 11/30 15/320 |
| 7,891,041 | B2 | 2/2011 | Dyer et al. | |
| 7,891,900 | B2 | 2/2011 | Clarke | |
| 8,608,395 | B2 | 12/2013 | Bober et al. | |
| 2008/0201877 | A1* | 8/2008 | Sengewald | A47L 11/085 15/4 |
| 2012/0246848 | A1* | 10/2012 | Hruby | A47L 11/1625 15/98 |

* cited by examiner

*Primary Examiner* — Randall E Chin

(57) ABSTRACT

A buffer stain applicator apparatus having a cylindrical reservoir having an open top, a bottom, and a side wall, wherein the bottom has an aperture. A lid is selectively engageable with the open top of the cylindrical reservoir. There is a pair of pole attachment rings configured to attach the apparatus to a pole of a floor buffer. A valve is disposed on the aperture of the bottom of the cylindrical reservoir. There is a flexible hose attached to a bottom side of the valve and disposed through a motor housing of the floor buffer. A lower end of the hose is disposed proximal a buffer pad of the floor buffer, and a nozzle is disposed on the lower end of the hose. The nozzle, the hose, the valve, and the reservoir are in fluid communication.

1 Claim, 4 Drawing Sheets

BUFFER STAIN APPLICATOR APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of stain applicators are known in the prior art. Stain treatment application to a large floor can be extremely time consuming and difficult. Furthermore, it is difficult to spread the stain evenly. What is needed, and what the present buffer stain applicator apparatus provides, is a cylindrical reservoir having an open top, a bottom, and a side wall, an aperture through said bottom, a lid that is selectively engageable with the open top, and a pair of pole attachment rings to attach the reservoir to a pole of a floor buffer. What is also needed is a valve disposed on the aperture of the bottom of the cylindrical reservoir, wherein the valve is in fluid communication with the reservoir, and a hose attached to a bottom side of the valve. The hose is disposed through a motor housing of the floor buffer, and a nozzle attached to the lower end of the hose is disposed proximal a buffer pad of the floor buffer.

FIELD OF THE INVENTION

The present invention relates to floor treatments, and more particularly, to a buffer stain applicator apparatus.

SUMMARY OF THE INVENTION

The general purpose of the present buffer stain applicator apparatus, described subsequently in greater detail, is to provide a buffer stain applicator apparatus that has many novel features that result in a buffer stain applicator apparatus that is not anticipated, rendered obvious, suggested, or even implied by prior art, either alone or in combination thereof.

To accomplish this, the present buffer stain applicator apparatus includes a cylindrical reservoir having an open top, a bottom, and a side wall, wherein the bottom has an aperture. A lid is selectively engageable with the open top of the cylindrical reservoir. There is a pair of pole attachment rings, wherein each of the pair of pole attachment rings has a first ring disposed on the side wall of the cylindrical reservoir and a second ring coplanarly disposed on the first ring. The second ring of each of the pair of pole attachment rings is configured to engage a pole of a floor buffer.

A valve is disposed on the aperture of the bottom of the cylindrical reservoir. There is a flexible hose, wherein an upper end of the hose is disposed on a bottom side of the valve, wherein the hose is disposed through a motor housing of the floor buffer. A lower end of the hose is disposed proximal a buffer pad of the floor buffer, and a nozzle is disposed on the lower end of the hose. The nozzle, the hose, the valve, and the reservoir are in fluid communication. A user can add stain treatment to the reservoir and through the open top and then seal the contents with the lid. The stain treatment then is released through the valve as controlled by the user, passing through the hose and out the nozzle onto the buffer pad of the floor buffer. The buffer pad then evenly applies and distributes the stain treatment to a floor.

Thus have been broadly outlined the more important features of the present buffer stain applicator apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
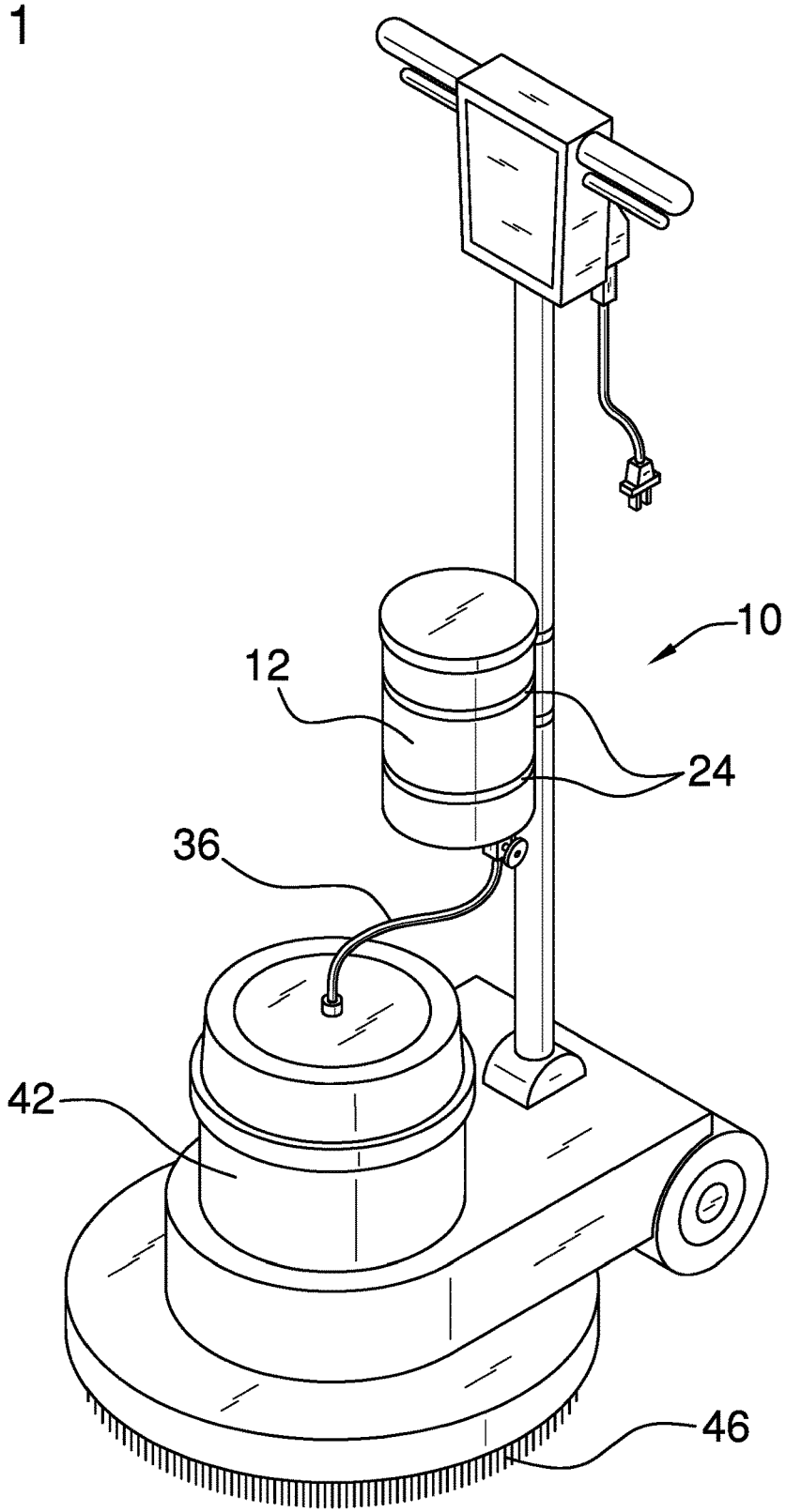
FIG. 1 is an isometric view of a buffer stain applicator apparatus.
Figure 2:
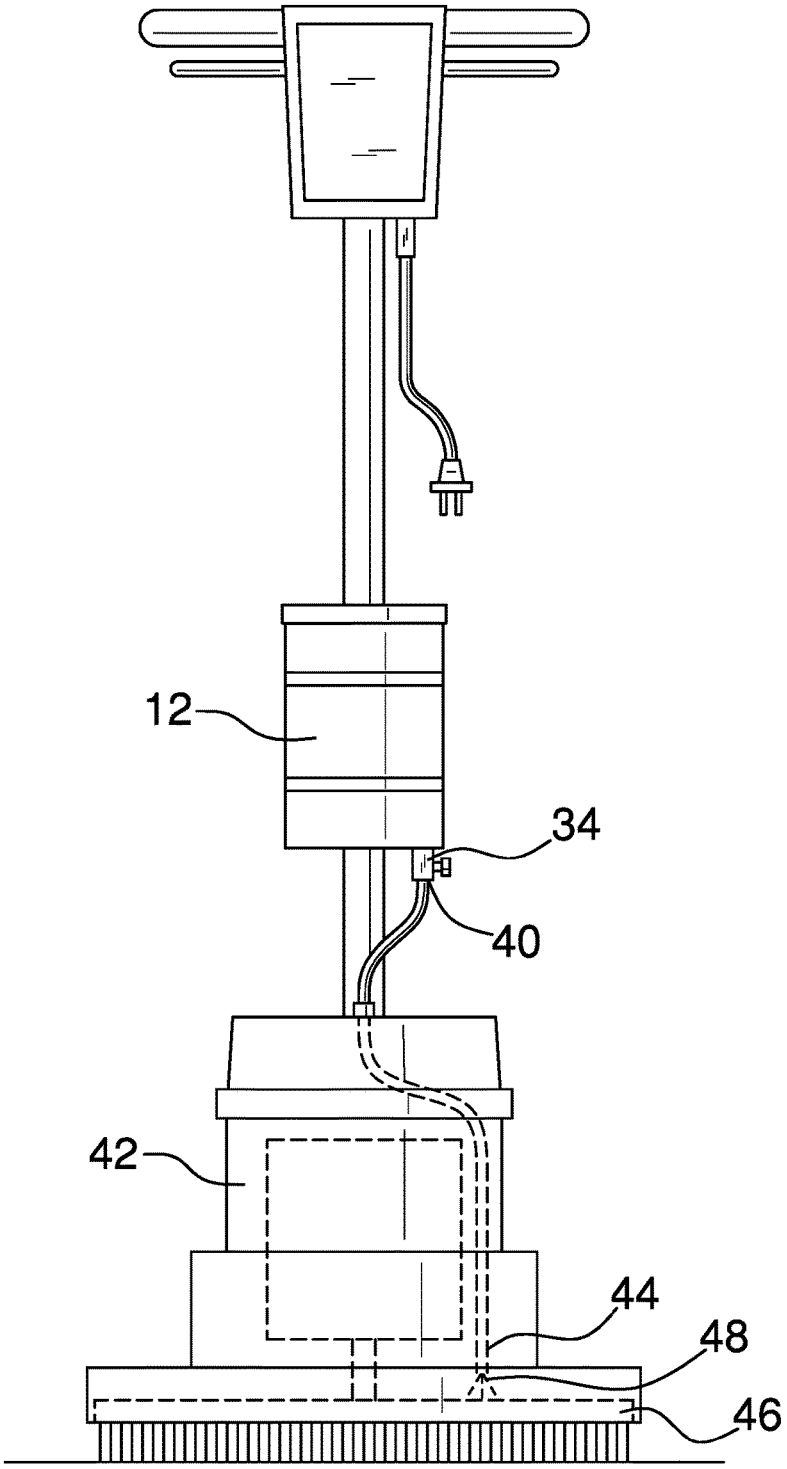
FIG. 2 is front elevation view of the buffer stain applicator apparatus.
Figure 3:
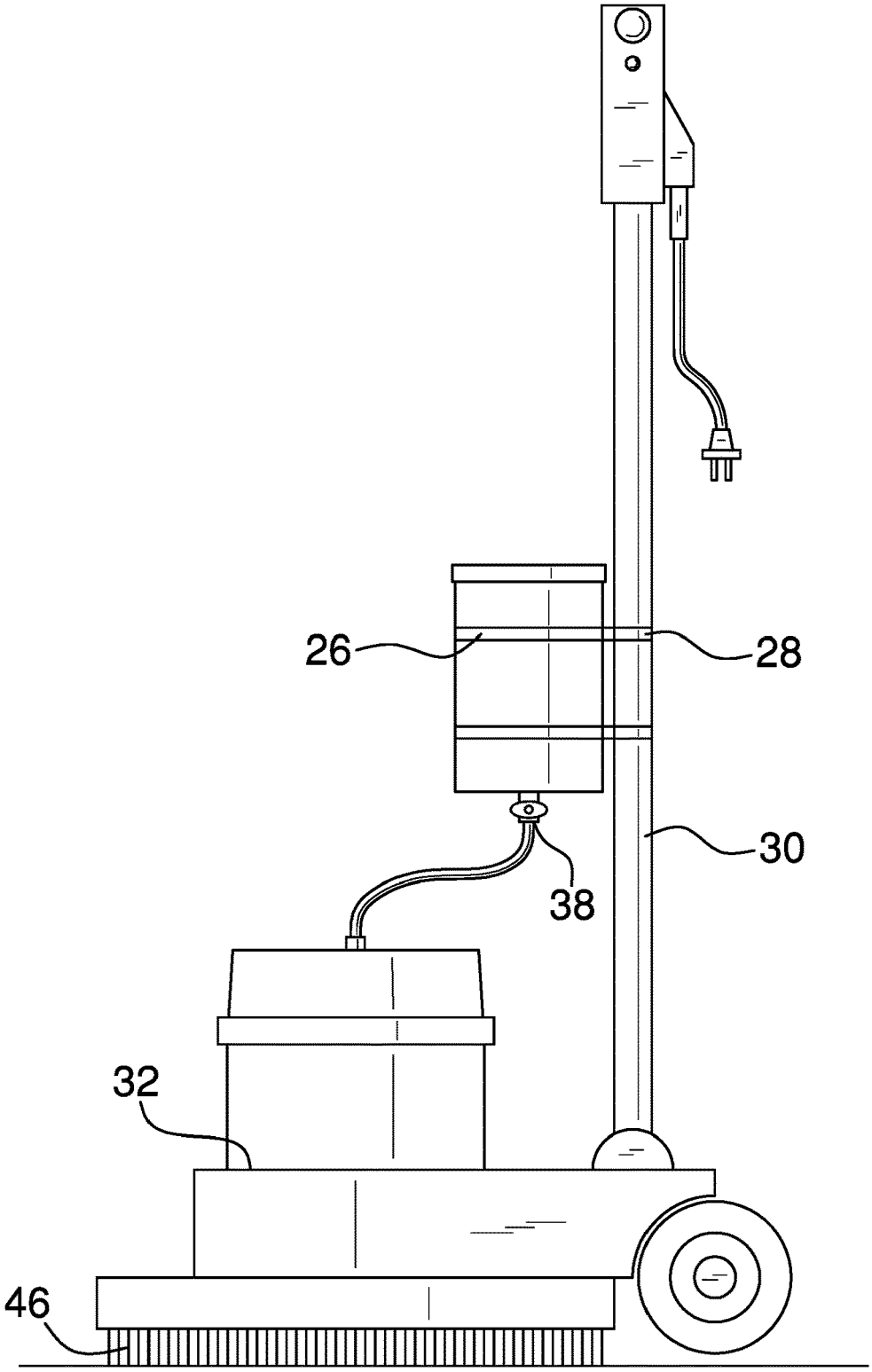
FIG. 3 is a side elevation view of the buffer stain applicator apparatus.
Figure 4:
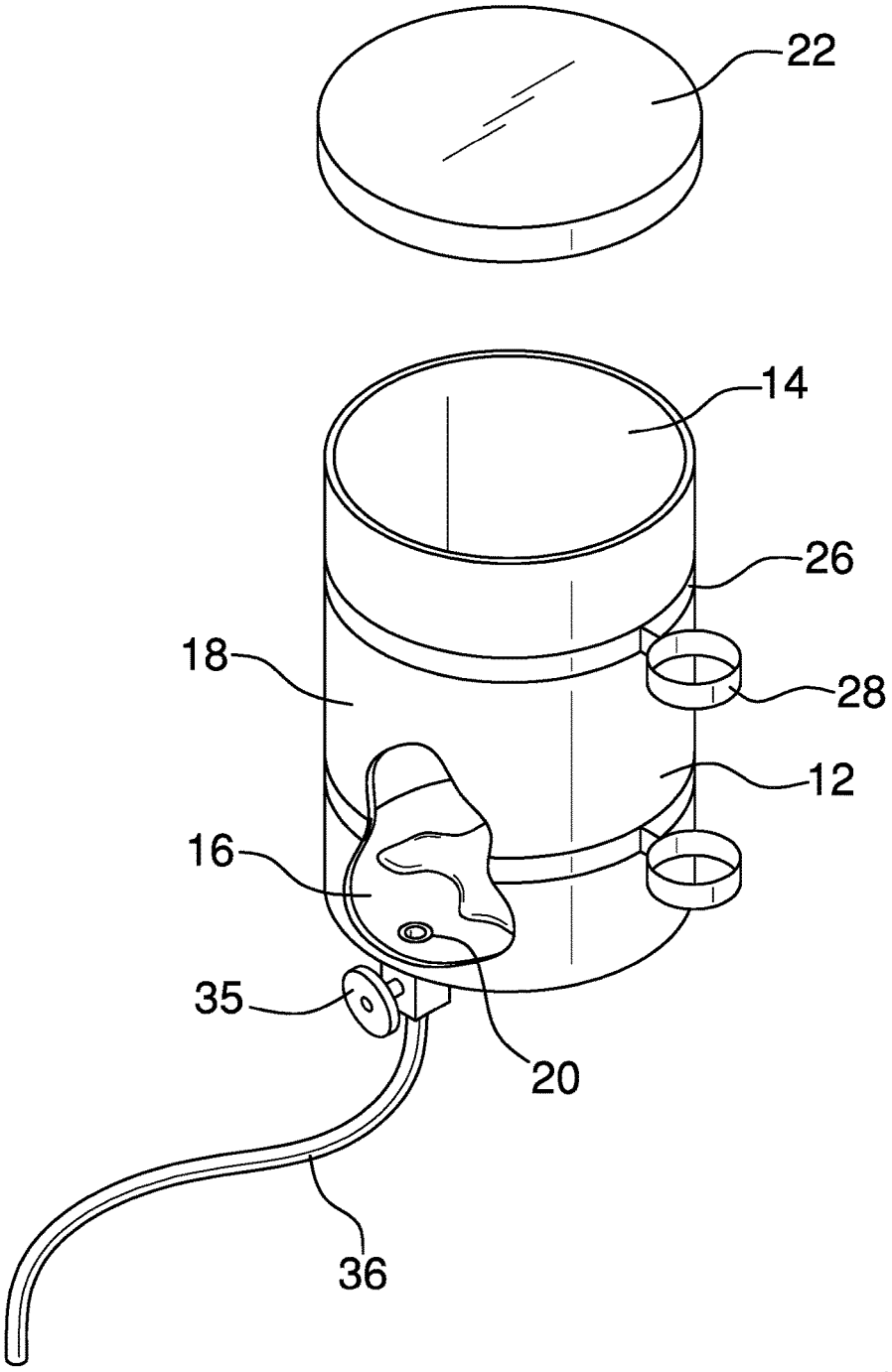
FIG. 4 is a detail view of the buffer stain applicator apparatus.

With reference now to the drawings, and in particular FIGS. 1 through 4 thereof, an example of the instant buffer stain applicator apparatus employing the principles and concepts of the present buffer stain applicator apparatus and generally designated by the reference number 10 will be described.

Referring to FIGS. 1 through 4 the present buffer stain applicator apparatus 10 is illustrated. The buffer stain applicator apparatus 10 includes a cylindrical reservoir 12 having an open top 14, a bottom 16, and a side wall 18, wherein the bottom has an aperture 20. A lid 22 is selectively engageable with the open top 14 of the cylindrical reservoir. There is a pair of pole attachment rings 24, wherein each of the pair of pole attachment rings has a first ring 26 disposed on the side wall 18 of the cylindrical reservoir and a second ring 28 coplanarly disposed on the first ring. The second ring 28 of each of the pair of pole attachment rings is configured to engage a pole 30 of a floor buffer 32.

A valve 34 is disposed on the aperture 20 of the bottom of the cylindrical reservoir. There is a flexible hose 36, wherein an upper end 38 of the hose is disposed on a bottom side 40 of the valve, wherein the hose is disposed through a motor housing 42 of the floor buffer. A lower end 44 of the hose is disposed proximal a buffer pad 46 of the floor buffer, and a nozzle 48 is disposed on the lower end 44 of the hose. The nozzle 48, the hose 36, the valve 34, and the reservoir 12 are in fluid communication.

What is claimed is:

1. A buffer stain applicator apparatus comprising:

a cylindrical reservoir having an open top, a bottom, and a side wall, wherein the bottom has an aperture;

a lid, wherein the lid is selectively engageable with the open top of the cylindrical reservoir;

a pair of pole attachment rings, wherein each of the pair of pole attachment rings has a first ring disposed on the side wall of the cylindrical reservoir and a second ring coplanarly disposed on the first ring, wherein the second ring is configured to engage a pole of a floor buffer;

a valve disposed on the aperture of the bottom of the cylindrical reservoir;

a hose, wherein an upper end of the hose is disposed on a bottom side of the valve, wherein the hose is disposed through a motor housing of the floor buffer, wherein a lower end of the hose is disposed proximal a buffer pad of the floor buffer; and a nozzle disposed on the lower end of the hose, wherein the nozzle, the hose, the valve, and the reservoir are in fluid communication.

* * * * *